US008166863B2

(12) United States Patent
Fullerton

(10) Patent No.: US 8,166,863 B2
(45) **Date of Patent: *May 1, 2012**

(54) MAGNETIC DAMPING FIELD ARMOR SYSTEM

(75) Inventor: Larry W. Fullerton, New Hope, AL (US)

(73) Assignee: Cedar Ridge Research LLC, New Hope, AL (US)

( * ) Notice: Subject to any disclaimer, the term of this patent is extended or adjusted under 35 U.S.C. 154(b) by 9 days.

This patent is subject to a terminal disclaimer.

(21) Appl. No.: 12/793,279

(22) Filed: Jun. 3, 2010

(65) Prior Publication Data

US 2012/0031259 A1 Feb. 9, 2012

Related U.S. Application Data

(63) Continuation of application No. 11/333,742, filed on Jan. 17, 2006, now Pat. No. 7,730,823.

(60) Provisional application No. 60/644,605, filed on Jan. 15, 2005.

(51) Int. Cl.
*F41H 5/04* (2006.01)
*F41H 5/06* (2006.01)

(52) U.S. Cl. ..... 89/36.17; 89/907; 89/910; 89/918

(58) Field of Classification Search ..... 89/36.01, 89/36.02, 36.17; 109/82, 85
See application file for complete search history.

(56) References Cited

U.S. PATENT DOCUMENTS

| | | | | |
|---|---|---|---|---|
| 4,840,105 | A * | 6/1989 | Ladan et al. | 89/1.13 |
| 5,922,986 | A * | 7/1999 | Wanninger et al. | 89/36.17 |
| 6,481,782 | B2 * | 11/2002 | Bond | 296/187.07 |
| 6,622,608 | B1 * | 9/2003 | Faul et al. | 89/36.17 |
| 6,758,125 | B1 * | 7/2004 | Zank | 89/36.17 |
| 7,730,823 | B1 * | 6/2010 | Fullerton | 89/36.17 |
| 2004/0118273 | A1 * | 6/2004 | Zank | 89/36.17 |
| 2004/0159228 | A1 * | 8/2004 | Budnik | 89/36.02 |
| 2004/0221712 | A1 * | 11/2004 | Stewart et al. | 89/36.05 |
| 2007/0044646 | A1 * | 3/2007 | Smiley | 89/36.07 |

* cited by examiner

*Primary Examiner* — Bret Hayes
(74) *Attorney, Agent, or Firm* — James Richards

(57) ABSTRACT

A resource is protected by an armor structure comprising a magnetic field such that the magnetic field will interfere with a warhead blast to weaken the blast. In particular, magnetic field will interfere with a molten metal jet from a shaped charge to disperse the jet, allowing subsequent layers of armor to absorb the jet energy without penetration. In one embodiment, the magnetic field is produced by a layer of magnetic material magnetized with the field lines perpendicular to the primary threat direction and typically parallel to the surface of the area to be protected. The magnetic material layer may include ferromagnetic (iron or steel, or other) layers to strengthen and contain the magnetic field, protect the magnetic material and act as additional armor layers. The magnetic layer is typically used in conjunction with an inner shield armor layer to absorb the diffused jet after passing through the magnetic layer.

15 Claims, 5 Drawing Sheets

MAGNETIC DAMPING FIELD ARMOR SYSTEM

RELATED APPLICATIONS

This application is a continuation of U.S. Non-provisional application Ser. No. 11/333,742 titled "Magnetic damping field armor system and method" filed Jan. 17, 2006, by Fullerton, which claims the benefit under 35 USC 119(a) of U.S. Provisional application 60/644,605 filed Jan. 15, 2005 by Fullerton, all of the above listed patent documents are hereby incorporated herein by reference in their entirety.

BACKGROUND

1. Field of the Invention

The present invention pertains to the field of protection of a resource by dispersion and distribution of threat energy, more particularly by using protective armor.

2. Background of the Invention

There is a class of weapon that uses a shaped charge to form a high-speed molten metal jet to cut through armor as a method of armor piercing. Once through the armor, the molten metal continues to do damage to personnel or items such as explosives stored behind the armor. One typical example of such a weapon is a Russian made RPG-7 (Rocket Propelled Grenade) that is being used extensively in Iraq to inflict casualties to US troops. The RPG-7 has been successful in penetrating many inches of steel armor and is notoriously difficult to develop protection against. One method of protection involves the use of high temperature materials, but the temperature of the shaped charge is effective in penetrating even the highest temperature materials. Alternatively, more and more armor may be used, but the weight becomes prohibitive, especially for mobile assets such as tanks and armored troop carriers. Another type of armor is active armor that explodes on contact or near contact to prematurely set off the shaped charge to disperse the energy and reduce the effectiveness. Active armor, however, when used is spent, providing no protection until replaced.

Therefore, there is a need for an effective method and system of protection against a shaped charge type of armor piercing round, yet is light enough to be used for mobile equipment including tanks and armored troop carriers and maintains integrity and effectiveness when attacked repeatedly.

BRIEF SUMMARY OF THE INVENTION

Briefly, a resource is protected by an armor structure comprising a magnetic field such that the magnetic field will interfere with a warhead blast to weaken the blast. In particular, magnetic field will interfere with a molten metal jet from a shaped charge to disperse the jet, allowing subsequent relatively light layers of armor to absorb the jet energy without penetration. In one embodiment, the magnetic field is produced by a layer of magnetic material magnetized with the field lines perpendicular to the primary threat direction and typically parallel to the surface of the area to be protected. The magnetic material layer may include ferromagnetic (iron or steel, or other) layers to strengthen and contain the magnetic field, protect the magnetic material and act as additional armor layers. The magnetic layer is typically used in conjunction with an inner shield armor layer to absorb the diffused jet after passing through the magnetic layer.

BRIEF DESCRIPTION OF THE FIGURES

The present invention is described with reference to the accompanying drawings. In the drawings, like reference numbers indicate identical or functionally similar elements. Additionally, the left most digit(s) of a reference number identifies the drawing in which the reference number first appears.

DETAILED DESCRIPTION OF THE PREFERRED EMBODIMENTS

The present invention is an armor system comprising a magnetic layer that disperses and deflects a molten metal jet from a shaped charge to allow the jet to be stopped or rendered ineffective by a subsequent layer of ordinary armor or other protective material. The magnetic layer may be effective against any molten jet, regardless of temperature, because the principle depends only on the magnetic and conductive properties of the jet. The dispersion of the jet is derived from Lenz's law, a law of physics discovered by the German scientist H. F. E. Lenz in 1834. Lenz's law states that the electromotive force (emf) induced in a conductor moving perpendicular to a magnetic field tends to oppose that motion. Thus, in accordance with the present invention, the molten jet forms a moving conductor in the magnetic field of the magnetic armor. Thus, the magnetic field acts to slow and deflect the conducting molten jet of metal. In the process of slowing the jet, the jet is broken up and dispersed over a wide area, reducing the penetration capability of the jet.

Figure 1A:
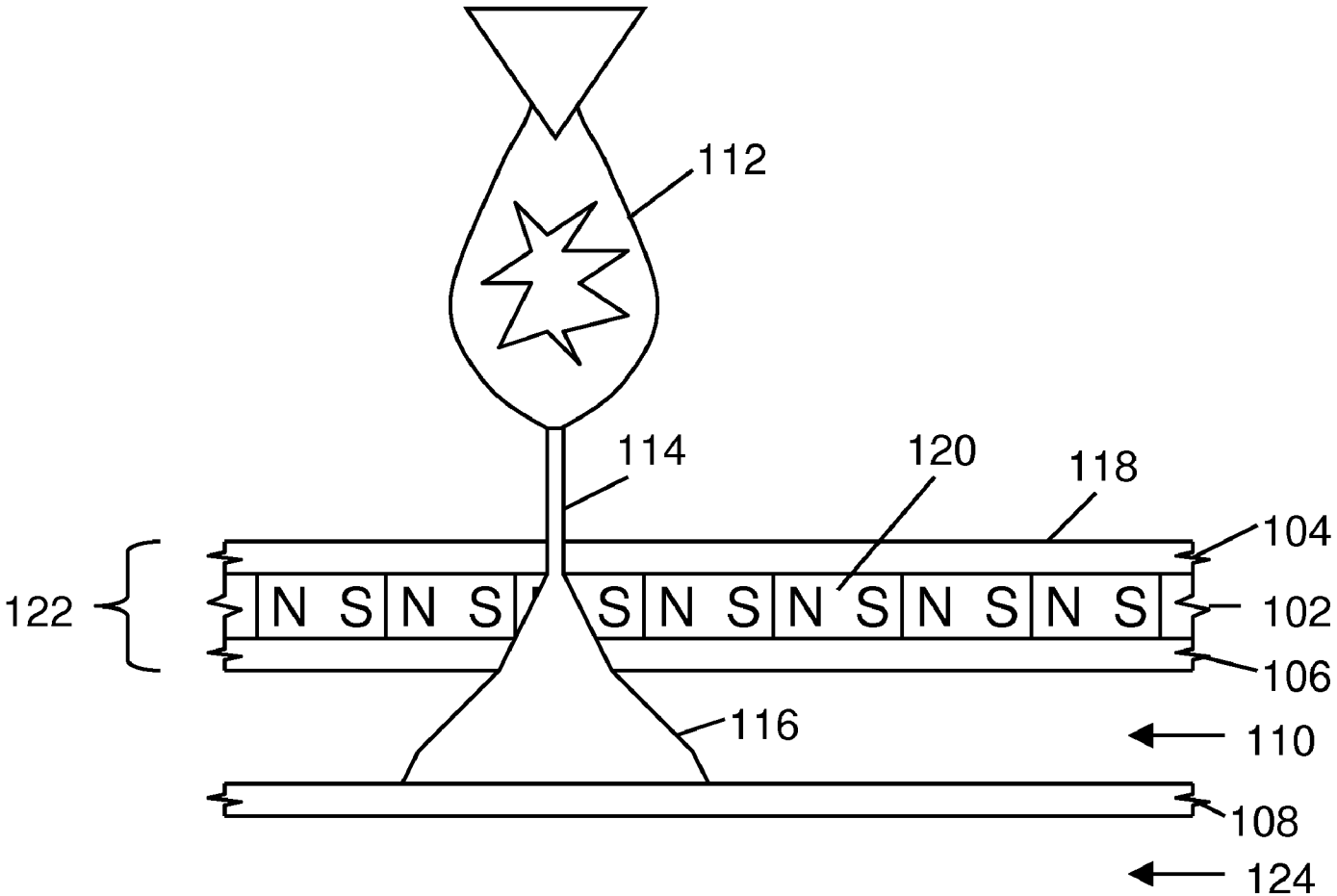
FIG. 1A illustrates an exemplary arrangement of layers of armor utilizing a magnetic layer to disperse a shaped charge in accordance with the present invention.

FIG. 1A illustrates an exemplary arrangement of layers of armor utilizing a magnetic layer to disperse a shaped charge in accordance with the present invention. Referring to FIG. 1A, the armor comprises an outer cladding layer 104 having a hard surface 118, a magnetic layer 102, an inner cladding layer 106 and a shield layer 108 spaced from the inner cladding layer 106 by an expansion space 110. An RPG 104 contacts the outer cladding layer 104 and triggers the shaped charge explosive 112. The explosive then melts a metal core and propels the molten metal 114 forward to penetrate the armor. The molten metal 114 penetrates the outer hard surface layer 104 and then encounters the magnetic field layer 102. Upon encountering the magnetic field layer 102, the metal jet 114 is dispersed 116. The jet may still be concentrated enough to penetrate the inner cladding 106, but continues to expand 116 in the space between the inner cladding and the blocking shield 108. Upon reaching the blocking shield, the blast 116 is dispersed sufficiently to be stopped by the blocking shield 108.

The magnetic layer 102 is magnetized parallel to the surface of the area to be protected 124 and perpendicular to the expected direction of the metal jet 114. This ensures that the incoming projectile 112 will have to cut through the magnetic lines of force contained within the magnetic armor 122 in order to reach the intended target 124. When such a conducting projectile 114 begins to penetrate the magnetic armor 122 and begins to cut through the magnetic lines of force contained within, the projectile 114 will be subjected to a braking force that is in accordance with Lenz's law:

$$F=Qv\times B$$

where,

F is the force vector;

Q is the charge;

v is the velocity vector of the charge;

B is the magnetic field vector; and x is the vector cross product operation.

When a conductor, such as the molten metal jet 114, penetrates the magnetic field 102, electric currents are generated within the conductor 114 and are experienced as eddy currents, or shorted current loops. These currents are oriented to generate counter-acting magnetic forces that oppose the field contained within the armor, thus slowing the forward progress of the conductor. Since the conductor is liquid, the slowing of the jet allows portions of the tail to catch up with the leading portion causing the jet to change from a pencil shape to that of a mushroom with the head toward the front. The increased cross section of the jet 114 caused by passage through the magnetic field 102 makes the expanded jet 116 vulnerable to conventional shielding or armor 108, since the pressure (force per square area) has been greatly reduced. Thus, the benefit of expanding the jet by using the magnetic layer is further enhanced by using a stopping shield 108 spaced from the magnetic layer to stop the expanded jet 116.

The outer cladding layer 104 may provide multiple benefits to the armor assembly 122. The outer layer 104 is a hard protective layer to protect the typically more fragile magnetic material 120 in the magnetic layer 102. The outer layer 104 may also be a ferromagnetic material to enhance the magnetic field by providing a return path for the field and also may provide a magnetic shielding function to keep the strong magnetic field contained within the armor and minimize the long range effect of the magnetic field. The outer layer also provides a hard surface 118 to trigger warheads 112 just prior to the magnetic layer 102. Further benefit may be obtained by having an additional outer layer (shown later in FIG. 4) spaced from the outer cladding layer to trigger warheads early. In some embodiments, the outer layers 104 and 106 may not be necessary, permitting the magnetic layer 102 to be used alone.

The magnetic layer 102 may comprise a permanent magnetic material such as Neodymium Iron Boron (NdFeB) magnetic material or other magnetic material. NdFeB is also called Neodymium magnetic material in this disclosure. Neodymium magnetic material is inexpensive, lightweight, and relatively non-toxic. Neodymium magnets may be extremely strong, permitting minim thickness of the magnetic layer 102. The magnetic layer 102 may be one continuous layer of magnetic material; however, magnetization may be greatly simplified by magnetizing smaller individual magnets 120 and assembling the multiple magnets 120 as shown in the FIG. 1A.

An inner cladding layer 106 may be provided to hold and protect the magnetic material 102. The inner cladding 106 may also be ferromagnetic and thus further contain and shield the magnetic field in a similar manner as the first cladding layer 104. The inner cladding layer 106 may also be a factor in the spreading of the jet 114 and may be optimized in thickness and material for best performance.

The blocking layer 108, if used, may also be the inner cladding layer 106; however, for best performance, the blocking layer 108 is an additional layer spaced from the magnetic layer 102 and cladding layers 104 and 106. The spacing 110 allows the jet 114 to further expand 116 before impacting the blocking layer 108. The blocking layer 108 is preferably high strength, high temperature material such as conventional steel armor. The blocking layer 108 is used to stop the expanded jet 116 of molten metal that emerges from the magnetic layer 102 after being velocity dampened. In the case of an add-on installation of magnetic armor, the magnetic layer assembly 122 may be added to the top of existing armor, using the existing armor for the blocking layer 108. In some cases, additional material may be added to augment existing armor for the blocking layer 108.

Figure 1B:
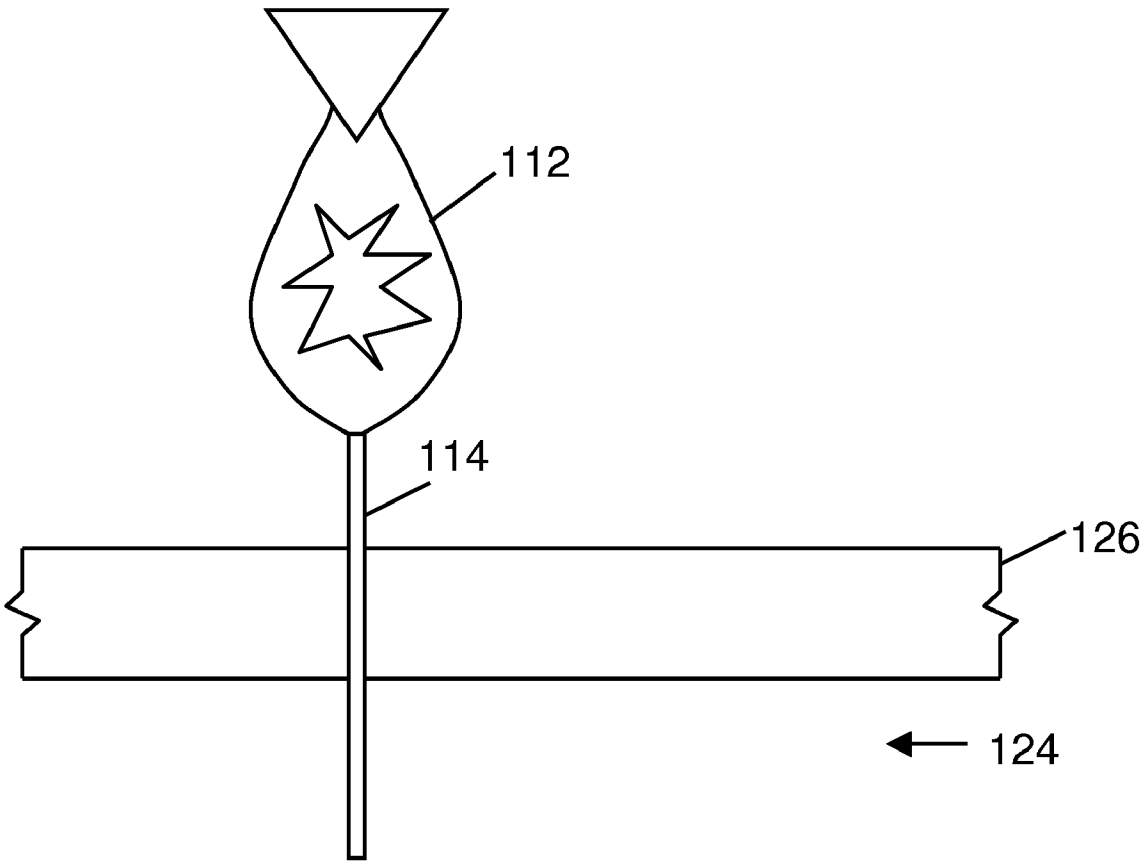
Fig. 1B Prior Art
FIG. 1B (prior art) illustrates the action of a shaped charge warhead on conventional armor.

FIG. 1B (prior art) illustrates the action of a shaped charge warhead 112 on conventional armor 126. In contrast with the armor if FIG. 1A, the conventional armor 126 of FIG. 1B does not disperse the shaped charge 114, which penetrates the armor 126 and invades the protected space 124.

Figure 2:
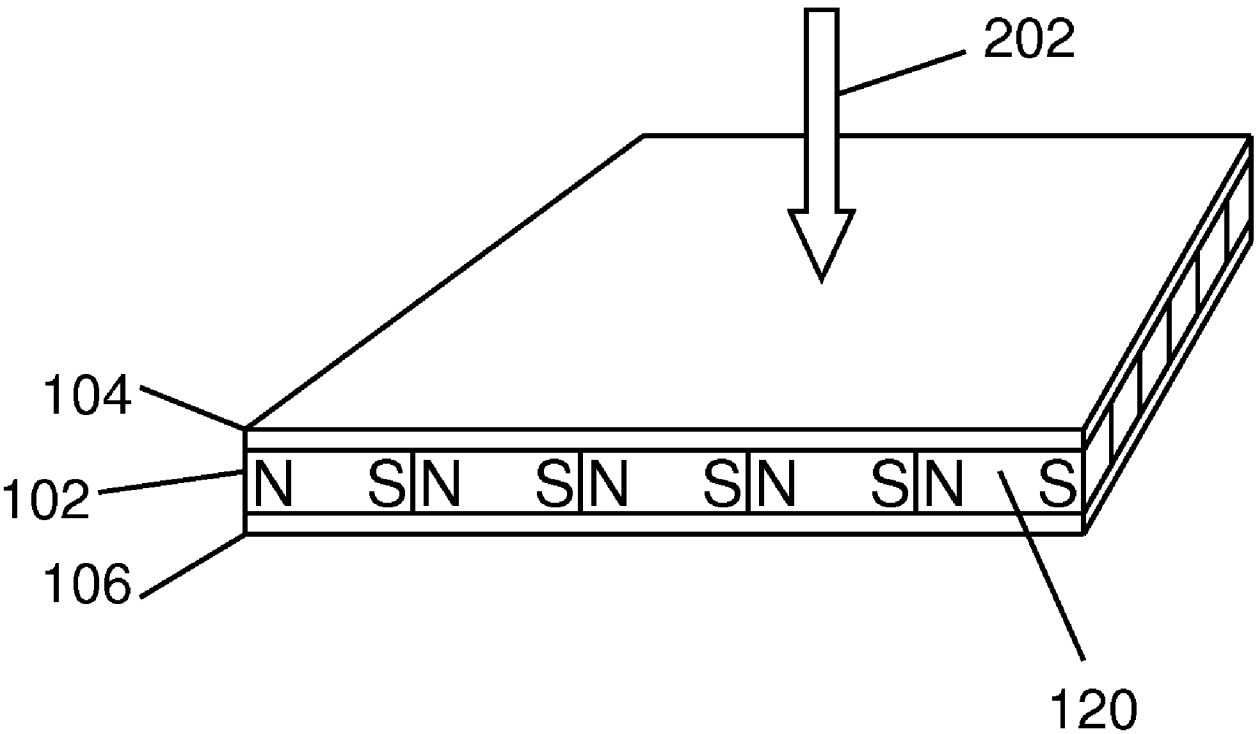
FIG. 2 illustrates a perspective view of the magnetic and cladding layers of FIG. 1A.

FIG. 2 illustrates a perspective view of the magnetic 102 and cladding layers 104, 106 of FIG. 1A. Referring to FIG. 2, the magnetic layer 102 comprises a plurality of magnets 120 assembled with the field in the same direction, parallel to the cladding plates 104, 106 and perpendicular to the direction 202 of the threat warhead as shown. Note that the warhead may come from any direction to penetrate the armor.

Figure 3:
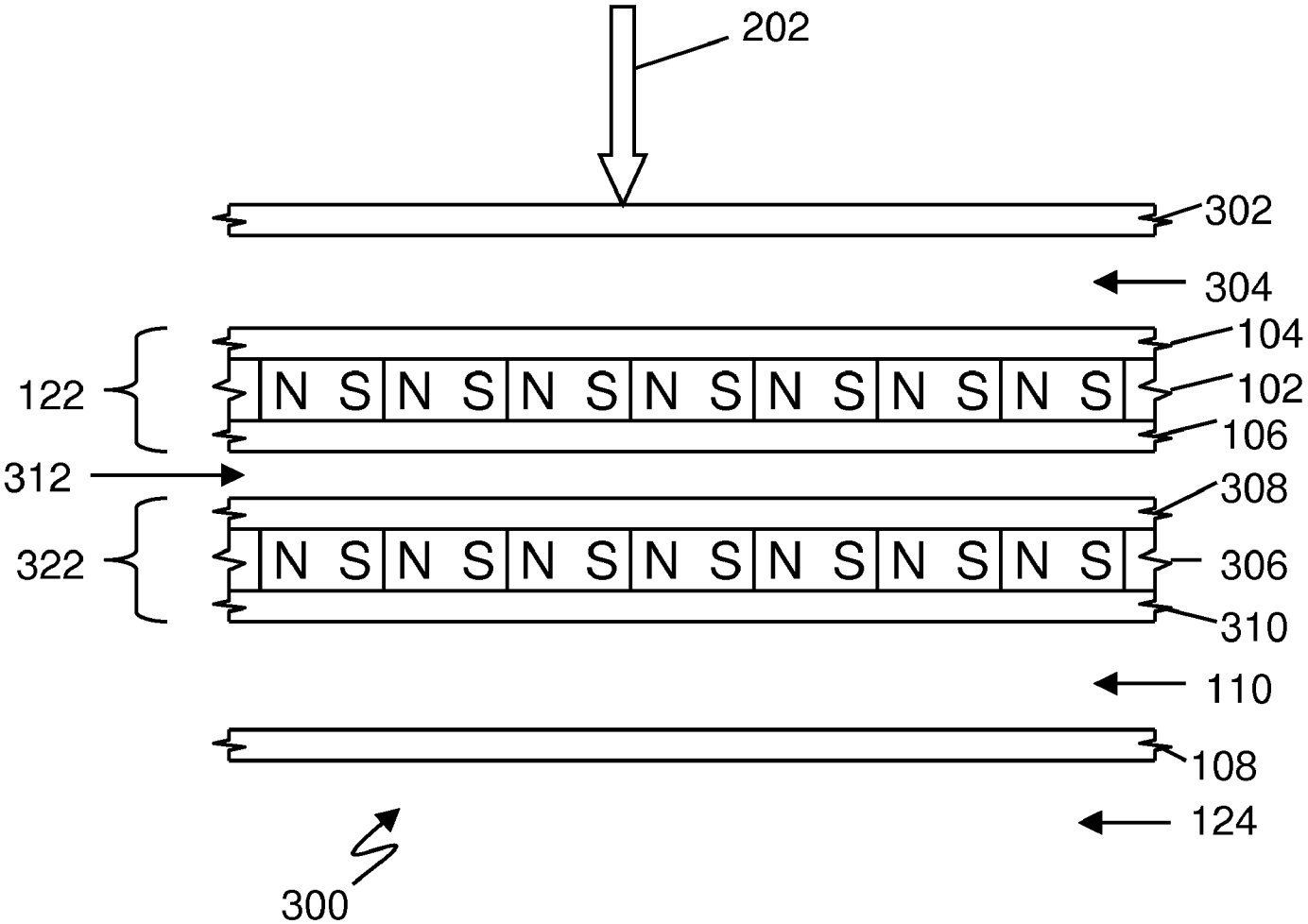
FIG. 3 illustrates an alternate layer stack including two magnetic layers in accordance with the present invention.

FIG. 3 illustrates an alternate layer stack including two magnetic layers in accordance with the present invention. FIG. 1A illustrates the basic layers that illustrate the principle of the invention; however, the system may be augmented with additional layers as needed for a particular application. FIG. 3 shows an additional magnetic layer assembly 322 including cladding layers along with an outer protective layer 302. Referring to FIG. 3, the armor system 300 comprises a first magnetic assembly 122 comprising a magnetic layer 102 and a first cladding layer 104 and a second cladding layer 106. The armor system 300 further includes a second magnetic assembly 322, also comprising a second magnetic layer 306 and third 308 and fourth 310 cladding layer. The second magnetic assembly 322 is spaced from the first magnetic assembly 122 with an air space 312 to allow expansion of the jet 114 to further weaken the jet 114. The armor system 300 also includes a blocking layer 108 spaced from the second magnetic assembly 322. Also shown is a top plate 302 to trigger the warhead 112 prematurely at a distance 304 from the first magnetic assembly 122. As many magnetic layers and additional layers may be used as are needed for a particular application.

Figure 4:
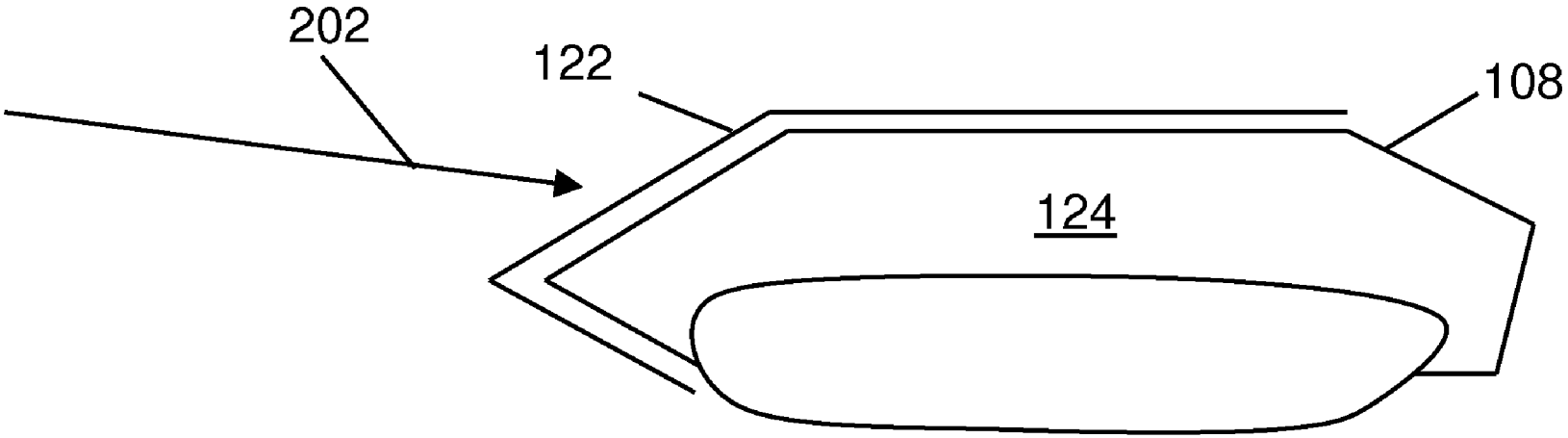
FIG. 4 illustrates an application of the invention and illustrates an angled orientation to the threat direction.

FIG. 4 illustrates an application of the invention and illustrates an angled orientation to the threat direction. Referring to FIG. 4, a tracked vehicle with existing armor 108 is fitted with magnetic armor 122. The nose of the vehicle is designed to provide a wedge shape to deflect the threat in addition to preventing penetration of the armor. The armor 122 is arranged at an angle (not perpendicular) to the threat direction 202 to cause the threat to impact the armor at an angle. The angle impact will tend to deflect warhead energy and/or cause the threat to take a longer path through the armor 122, effectively increasing the thickness of the armor 122. In the angled armor embodiment, the magnetic direction may be preferably in a horizontal plane so that the magnetic vector is most nearly perpendicular to the threat direction.

CONCLUSION

Thus described is a new protective armor system especially adapted to defending against armor piercing shaped charge weapons, yet is light enough to be used for mobile equipment including tanks and armored troop carriers and maintains integrity and effectiveness when attacked repeatedly.

While particular embodiments of the invention have been described, it will be understood, however, that the invention is not limited thereto, since modifications may be made by those skilled in the art, particularly in light of the foregoing teachings. It is, therefore contemplated by the appended claims to cover any such modifications that incorporate those features or those improvements which embody the spirit and scope of the present invention.

What is claimed is:

1. An armor system for protecting a resource from a shaped charge warhead, said armor system comprising:

an armor layer; and a first magnetic field layer disposed as a layer relative to said armor layer;

said first magnetic field layer generating a first magnetic field having magnetic field force lines substantially parallel to a surface of said armor layer, said armor layer being parallel to said first magnetic field layer, said armor layer configured for disposition between said first magnetic field layer and a resource, said armor system subjecting a blast from a shaped charge warhead to a braking force that is in accordance with Lenz's law, said braking force deflecting a molten metal jet of the shaped charge warhead blast and preventing penetration of said armor layer.

2. The armor system of claim 1, further comprising:

a first cladding layer to protect said first magnetic field layer.

3. The armor system of claim 2, wherein said first cladding layer reduces an external magnetic field.

4. The armor system of claim 2, wherein said first cladding layer is ferromagnetic.

5. The armor system of claim 2, further comprising a second cladding layer to protect said first magnetic field layer.

6. The armor system of claim 5, wherein said second cladding layer is ferromagnetic.

7. The armor system of claim 1, wherein said first magnetic field layer comprises a permanent magnetic material.

8. The armor system of claim 7, wherein said permanent magnetic material comprises a ceramic magnetic material.

9. The armor system of claim 8, wherein said ceramic magnetic material comprises neodymium iron boron.

10. The armor system of claim 7, wherein said permanent magnetic material comprises a plurality of magnets.

11. The armor system of claim 1, wherein the first magnetic field layer is arranged so that a magnetic vector of the first magnetic field layer is most nearly perpendicular to an expected threat arrival vector.

12. The armor system of claim 1, further comprising:

an outer layer adapted for triggering of said shaped charge warhead.

13. The armor system of claim 1, wherein said armor layer is spaced from said first magnetic field layer.

14. The armor system of claim 1, further comprising:

a second magnetic field layer generating a second magnetic field.

15. An armor system for providing a predetermined protected space for protecting a resource from a shaped charge warhead, said armor system comprising:

an armor layer; and a first magnetic field layer;

said first magnetic field layer and said armor layer forming layers relative to one another;

said first magnetic field layer and said armor layer having sufficient lateral dimension to intercept an incoming warhead from a predetermined range of trajectory angles directed to the predetermined protected space;

said armor system for disposition between said predetermined protected space and a threat source to intercept an incoming warhead directed to said predetermined protected space;

said magnetic field layer magnetized parallel to said magnetic field layer;

first magnetic field layer configured for subjecting a molten metal jet from a shaped charge warhead to a braking force that is in accordance with Lenz's law, said braking force preventing complete penetration of said armor layer by the molten metal jet.

* * * * *